US005205528A

United States Patent [19]

Cunningham

[11] Patent Number: 5,205,528

[45] Date of Patent: Apr. 27, 1993

[54] EARTHQUAKE-RESISTANT ARCHITECTURAL SYSTEM

[76] Inventor: John Cunningham, 35 Louthberry Rd., Saratoga Springs, N.Y. 12866

[21] Appl. No.: 870,261

[22] Filed: Apr. 17, 1992

[51] Int. Cl.[5] ..... F16M 13/00

[52] U.S. Cl. ..... 248/602; 52/167 RM; 248/678

[58] Field of Search ..... 248/424, 560, 562, 571, 248/581, 602, 611, 619, 672, 675, 676, 678; 52/167 R, 167 RM; 14/73.1, 6, 9

[56] References Cited

U.S. PATENT DOCUMENTS

| | | | |
|---|---|---|---|
| 363,970 | 5/1887 | Sherwood | 14/16.1 X |
| 382,207 | 5/1888 | Barrow | 248/560 |
| 929,118 | 7/1909 | Buckwalter . | |
| 2,021,370 | 11/1935 | Mallay | 248/560 |
| 2,058,185 | 10/1936 | Simon | 248/602 |
| 3,244,393 | 4/1966 | Wallerstein, Jr. . | |
| 3,269,069 | 8/1966 | Carlson | 52/573 X |
| 3,848,842 | 11/1974 | Jepsen . | |
| 3,906,689 | 9/1975 | Nakayama | 52/167 RM |
| 4,004,766 | 1/1977 | Long | 248/580 X |
| 4,063,646 | 12/1977 | Stahl, Jr. | 211/70.8 X |
| 4,209,868 | 7/1980 | Tada et al. | 52/167 X |
| 4,496,130 | 1/1985 | Toyama | 52/167 X |
| 4,588,154 | 5/1986 | Basore | 211/206 X |
| 4,946,128 | 8/1990 | Cunningham | 248/560 |

FOREIGN PATENT DOCUMENTS

| | | | |
|---|---|---|---|
| 0102945 | 4/1990 | Japan | 248/560 |

*Primary Examiner*—Ramon O. Ramirez
*Attorney, Agent, or Firm*—Joseph Scafetta, Jr.

[57] ABSTRACT

An earthquake-resistant architectural system incorporates a number of homeostatic devices which offer increasing, instead of decreasing, resistance to a load and its resulting stresses. A common feature of the improvement is that support posts are topped by bearings facing each other and having grooved channels which are inclined at an angle to the longitudinal axis of each resilient transverse member at rest, so that a horizontal distance, when measured in a straight line between opposite points of contact in the grooved channels, decreases as the load increases and bends each resilient transverse member.

20 Claims, 5 Drawing Sheets

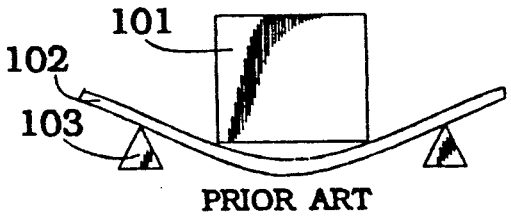
Fig. 1
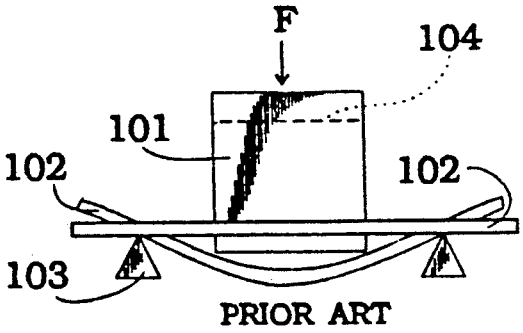
Fig. 2
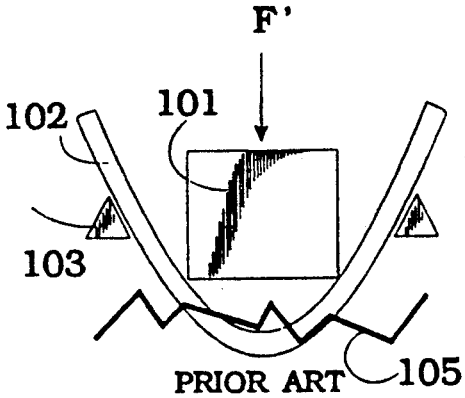
Fig. 3
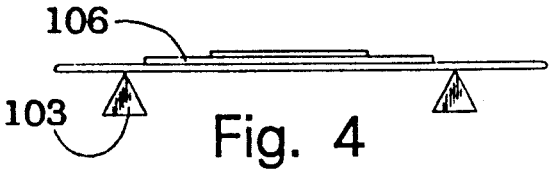
Fig. 4
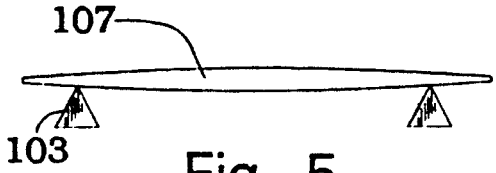
Fig. 5
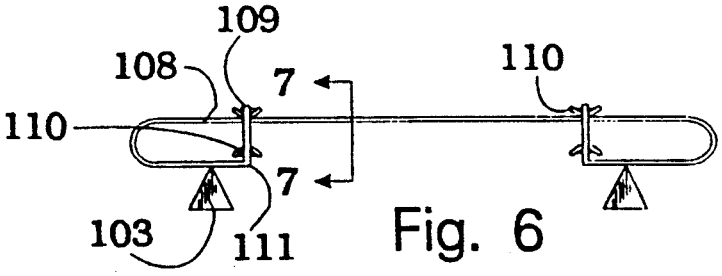
Fig. 6
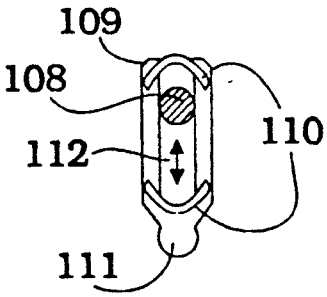
Fig. 7
Fig. 8
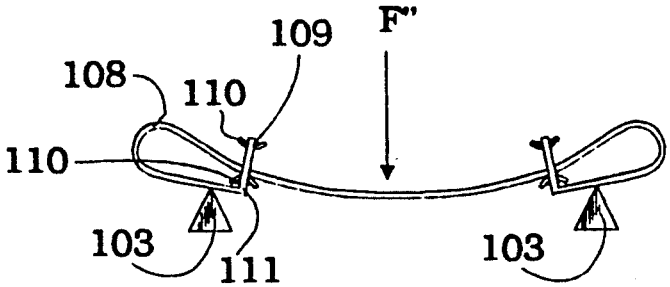

EARTHQUAKE-RESISTANT ARCHITECTURAL SYSTEM

BACKGROUND OF THE INVENTION

1. Field of the Invention

The present invention relates to static structures and supports generally, but more particularly to an earthquakeresistant architectural system for bridges and buildings.

2. Description of the Related Art

Properly designed and constructed homeostatic systems exist in dynamic equilibrium. "Homeostasis" is defined as "a relatively stable state of equilibrium or a tendency toward such a state between the different but interdependent elements or groups of elements of an organism or group." See Webster's New Collegiate Dictionary published by the G. & C. Merriam Co. in 1976.

This equilibrium continues as long as a homeostatic or critical angle is greater than 25 degrees from a vertical axis of support for the system. A more detailed discussion of this concept appears in U.S. Pat. No. 4,946,128 which issued to Cunningham on Aug. 7, 1990, for a homeostatic lifting and shock-absorbing support system.

Homeostatic systems may fail, however, if this critical angle becomes less than 25 degrees due to excessive forces and vibrations being applied to the system. As the critical angle approaches zero degrees, rigid transverse support members for the system offer decreasing resistance to the applied forces. This occurs in situations of unusual stresses, such as earthquakes.

Thus, it remains a problem in the prior art to construct bridges and buildings which do not fail under the conditions of severe earthquakes.

SUMMARY OF THE INVENTION

An architectural system is made resistant to the loads and stresses induced by strong earthquakes by incorporating a number of homeostatic devices which offer increasing, instead of decreasing, resistance to such forces.

The earthquake-resistant architectural system is characterized by support posts that are topped by bearings facing each other and having grooved channels which are inclined at an angle to the longitudinal axis of each resilient transverse member at rest, so that the distance between opposite points of contact in each grooved channel decreases as the load increases and flexes each resilient transverse member.

Thus, it is a primary object of the invention to construct an architectural system which protects against the effects of violent earthquakes.

It is a secondary object of the invention to provide efficient, economical and practical shock-absorbing transverse members on support posts.

It is a tertiary object of the invention to incorporate bearings which cause the resilient transverse members to offer increasing resistance as they bend in response to the shocks of earthquakes.

It is another object to build homeostatic devices which resist failure as the critical angle decreases below 25 degrees due to ever increasing applied forces.

It is an additional object to design static structures and supports which offer increasing resistance to further bending of its transverse members as the critical angle decreases below 25 degrees.

It is a further object to provide grooved channels which are inclined at an angle to the longitudinal axis of each resilient transverse member so that the supported length between two bearing points for each member is shortened as the member flexes, thus causing the member to grow increasingly resistant to further bending as the applied load increases.

It is also an object to construct rigid bearings which may be either bonded, cast, bolted, embedded or otherwise attached on top of vertical support posts, thus forming bearing points at or near ends of each resilient transverse member.

It is likewise an object to arrange each rigid bearing so that a resilient transverse member may be slidable in a grooved channel thereof at an angle to the horizontal axis whenever a load is applied to the transverse member.

Finally, it is an object to design a modular architectural system to support a load which is applied over a large area.

These objects and other advantages of the present invention will become more readily understandable after reviewing the immediately following brief description of the drawings and then studying the subsequent detailed description of the preferred embodiments.

BRIEF DESCRIPTION OF THE DRAWINGS

FIG. 1 is a schematic representation of a load in equilibrium on a prior art support system.

FIG. 2 shows a force applied to the load on the prior ar support system of FIG. 1.

FIG. 3 shows an excessive force applied to the load, thus causing failure of the prior art support system of FIG. 1.

FIG. 4 shows a first embodiment of a resilient transverse member being laminated and resting on two bearing points of the prior art support system of FIG. 1.

FIG. 5 shows a second embodiment of the resilient transverse member being tapered and resting on the same two bearing points of the prior art support system of FIG. 1.

FIG. 6 shows a third embodiment of the resilient transverse member being recurved upon itself to form c-shaped ends and also resting upon the same two bearing points of the prior art support system of FIG. 1.

FIG. 7 is a cross-sectional view taken along line 7—7 in FIG. 6.

FIG. 8 shows a large force applied to the third embodiment of the resilient transverse member shown in FIG. 6.

DETAILED DESCRIPTION OF THE PREFERRED EMBODIMENTS

Figure 9:
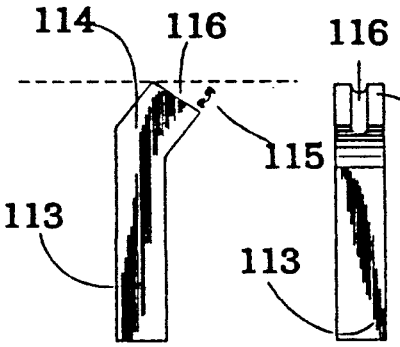
FIG. 9 is a side elevational view of a support post having a first embodiment of a bearing of the present invention.

In FIG. 1, a conventional prior art arrangement of an architectural system in equilibrium is shown in which a load 101 flexes a bar 102 supported near its opposite ends at bearing points 103.

In FIG. 2, the conventional prior art arrangement is shown in an initial unloaded condition immediately before the load 101 is placed on the straight flexed bar 102 and in a loaded condition immediately after a small force F is applied to the load 101 to bend the bar 102 downwardly so that the load 101 is displaced to a lower position 104.

In FIG. 3, a large excessive force F′ is applied to the load 101 so that the flexed bar 102 fractures along a schematic line 105, thus resulting in catastrophic failure of the conventional prior art arrangement of the architectural system shown in FIGS. 1 and 2.

In FIG. 4, a first embodiment of a resilient transverse member 106 of the present invention is shown to be laminated and to rest on the two bearing points 103 of the prior art. The member 106 offers gradual but stepped increasing resistance to an applied load as the member 106 flexes in response thereto. The member 106 is unrestrained at its ends and has a smooth bottom surface so as to make continuously sliding contact with the bearing points 103.

In FIG. 5, a second embodiment of the present invention is shown in which a resilient transverse member 107 is tapered towards its ends and rests on the same two bearing points 103 of the prior art. The member 107 offers gradually tapered increasing resistance to an applied load as the member 107 flexes in response thereto.

In FIG. 6, a third embodiment of the present invention is shown in which a resilient transverse member 108 is recurved upon itself to form opposite c-shaped ends. The member 108 also rests upon the same two bearing points 103 of the prior art. Each c-shaped end of the member 108 is attached at an end point 111, e.g. by welding to an apertured plate 109. Line 7—7 in FIG. 6 is a cross-section of a view shown in FIG. 7.

In FIG. 7, the end point 111 is shown to be welded to the plate 109 that has a slot 112 in which the member 108 moves up and down between upper and lower curved channels 11.

In FIG. 8, a large force F″ is shown to be applied to the member 108 resting on the bearing points 103 of the prior art. When the member 108 contacts the lower curved channel 110 in the plate 109 at the end point 111, the resistance of the architectural system to the force F″ is increased and further deflection of the member 108 is minimized.

Figure 10:
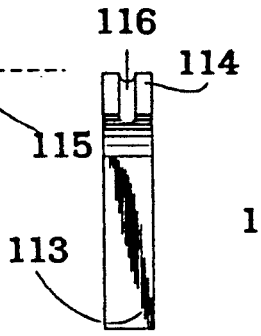
FIG. 10 is a front elevational view of the support post shown in FIG. 9.

Whereas FIGS. 4–8 show three different embodiments of the resilient transverse member of the present invention, FIGS. 9 and 10 show an embodiment of a support post 113 of the present invention.

In FIG. 9, a side elevational view of the support post 113 is shown to have an inclined bearing portion 114 in which a channel 116 is formed. The bearing portion 114 is bent at an angle 115 from a horizontal ordinate shown in dotted lines.

In FIG. 10, a front elevational view of the support post 113 is shown. In this view, a groove in the channel 116 in the bearing portion 114 is illustrated.

Figure 11:
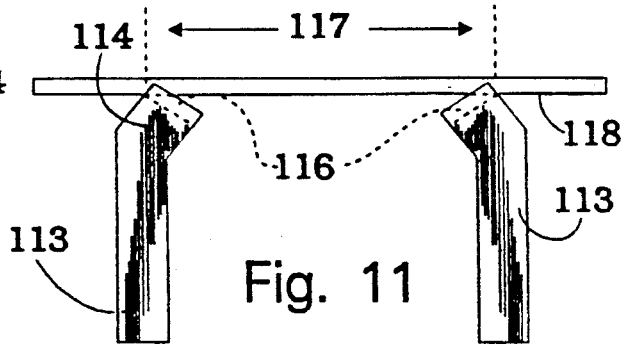
FIG. 11 is a schematic representation of a fourth embodiment of the resilient transverse member resting on two spaced support posts.
Figure 12:
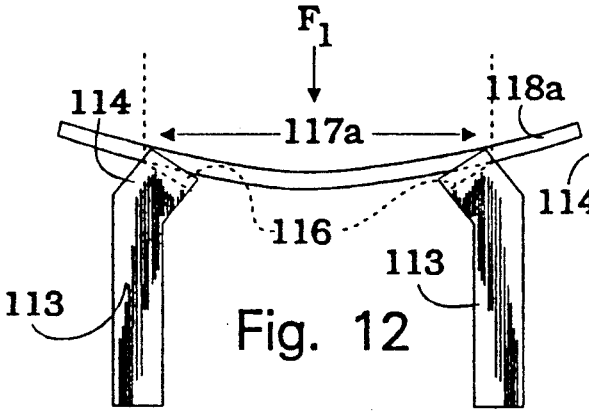
FIG. 12 shows a small force applied to the fourth embodiment of the resilient transverse member shown in FIG. 11.
Figure 13:
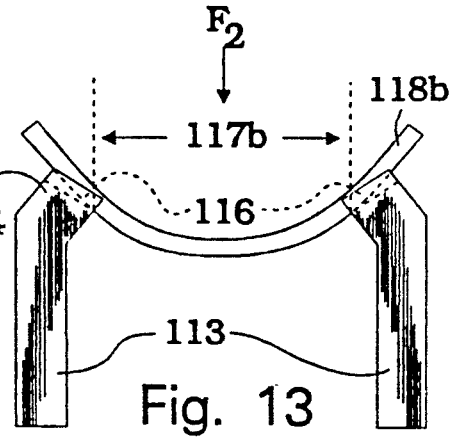
FIG. 13 shows a large force applied to the fourth embodiment of the resilient transverse member shown in FIG. 11.

In FIGS. 11–13, a fourth embodiment of the resilient transverse member of the present invention is illustrated.

In FIG. 11, the transverse member rests in the grooved channels 116 of the bearing portions 114 which face each other on the two spaced support posts 113. The transverse member is a cylindrical rod and has a central portion 117 suspended between the two posts 113. Two end portions 118 of the transverse member overhang from the grooved channels 16 which have opposite open ends. The bearing portions 114 are inclined at an angle from a vertical axis of the support posts 113.

In FIG. 12, a small force $F_1$ is applied to the fourth embodiment of the transverse member. In order to reach a state of equilibrium with the small force $F_1$, the transverse member bends and slides a short distance in the grooved channels 116 of the bearing portions 114 of the support posts 113. After the state of equilibrium is reached, a central portion 117*a* of the transverse member is shorter, when measured horizontally in a straight line, than the central portion 117 when the member is at rest, as seen in FIG. 11. End portions 118*a* of the transverse member shown in FIG. 12 are also shorter than the end portions 118 when the member is at rest in FIG. 11 because, as the small force $F_1$ pushes down on the transverse member, more of the transverse member is curved between the support posts 113. Hence, any overhang of the end portions 118*a* necessarily decreases. These end portions 118*a* overhang opposite open ends of the grooved channels 116.

In FIG. 13, a large force $F_2$ is applied to the fourth embodiment of the transverse member. In order to reach a state of equilibrium with the large force $F_2$, the transverse member bends and slides further to a maximum distance marked by inner ends of the grooved channels 116 until equilibrium is achieved. In this state, a central portion 117*b* of the transverse member is shorter, when measured horizontally in a straight line, than the central portion 117*a* in FIG. 12. Also, end portions 118*b* of the transverse member in FIG. 13 are shorter than the end portions 118*a* in FIG. 12 because, as the large force $F_2$ pushes the transverse member farther down, more of the transverse member is bent between the support posts 113. Thus, any overhang of the end portions 118*a* once again decreases. Furthermore, the end portions 118*b* likewise overhang opposite open ends of the grooved channels 116.

If the force $F_2$ in FIG. 13 equals the force F' in FIG. 3 of the prior art, the transverse member of the present invention does not fracture whereas the bar 102 of the prior art fails. The reason why the present invention does not fail is that the grooved channels 116 in the bearing portions 114 of the support posts 113 allow the resilient transverse member to slide therein in order to redistribute the applied load while the bearing points 103 of the prior art do not permit such redistribution.

Figure 14:
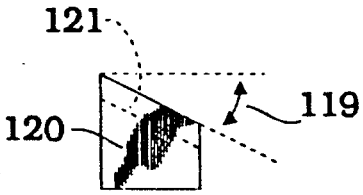
FIG. 14 is a side elevational view of a second embodiment of a bearing of the present invention.
Figure 15:
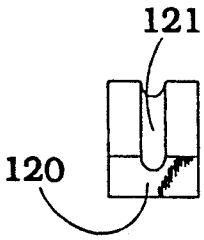
FIG. 15 is a front elevational view of the second embodiment of the bearing shown in FIG. 14.

FIGS. 14 and 15 illustrate a second embodiment of a bearing of the present invention. In FIG. 14, a side elevational view is shown while a front elevational view is shown in FIG. 15.

In FIG. 14, a bearing 120 is shown to have a channel 121 which forms an angle 119 inclined downwardly from a horizontal ordinate. In FIG. 15, the channel 121 of the bearing 120 is seen to be grooved. This bearing 120, which is rigid and upright, is analogous to the inclined bearing portion 114 shown in FIGS. 9–13 and may be substituted therefor on the support post 113. However, the bearing 120 has its vertical axis aligned coaxially with the vertical axis of the support post 113 shown in FIGS. 9–13.

Figure 16:
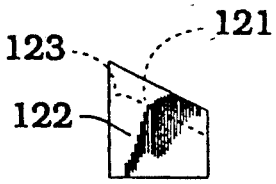
FIG. 16 is a side elevational view of a third embodiment of the bearing of the present invention.

In FIG. 16, a side elevational view of a third embodiment of the bearing of the present invention is shown. In this third embodiment, a rigid upright bearing 122 has the same grooved channel 121 seen in FIGS. 14 and 15 illustrating the second embodiment, except that this third embodiment has a rounded upper e 123 in the grooved channel 121 for the purpose of allowing a transverse member to remain at rest without causing notches to be cut therein as would occur if the upper edge 123 were sharp and came to a point. The rounded upper edge 123 also prevents the transverse member from grabbing and catching thereon, as would occur if the edge 123 were sharp, particularly when the transverse member slides back and forth in the grooved channel 121 due to multiple shocks applied to the architectural system of the present invention, e.g., during a severe earthquake.

Figure 17:
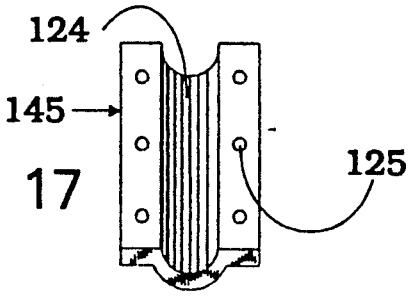
FIG. 17 is a top perspective view of a bearing plate to be bolted onto either the support posts shown in FIGS. 9–13 or the bearings shown in FIGS. 14–16.

In FIG. 17, a top perspective view of a bearing plate 145 is shown. The bearing plate 145 has a grooved channel 124 and a plurality of bores 125 drilled through flanges running adjacent to the channel 124. The bores 125 allow the bearing plate 145 to be bolted or otherwise securely fastened either onto the grooved channels 116 in the inclined bearing portions 114 of the support posts 113 shown in FIGS. 9–13 or onto the grooved channels 121 in the rigid upright bearings 120 and 122 shown in FIGS. 14–16.

Figure 18:
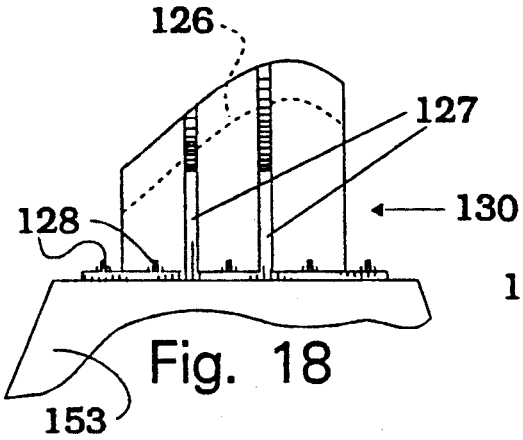
FIG. 18 is a side elevational view of a fourth embodiment of the bearing having affixed on top thereof a bearing plate of the present invention.

FIGS. 18–21 illustrate a fourth embodiment of the bearing of the present invention. In FIG. 18, a side elevational view is shown; in FIG. 19, a rear elevational view is shown; and in FIG. 20, a top plan view is shown.

In FIG. 18, a bearing 130 is shown to have an inclined channel 126 and vertically reinforcing side ribs 127. Bolts 128 fasten the bearing 130 to a support post 153.

Figure 19:
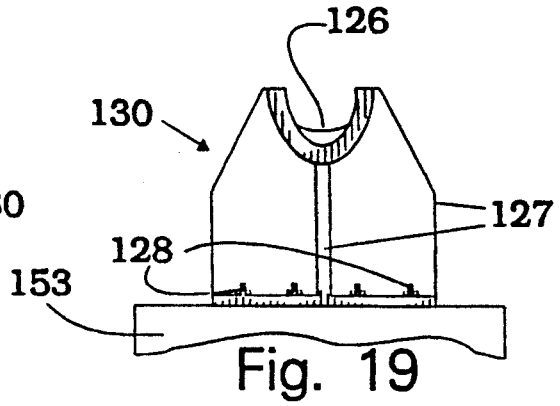
FIG. 19 is a rear elevational view of FIG. 18.

In FIG. 19, the inclined channel 126 of the bearing 130 is seen in this rear view to be grooved and to have a rounded upper edge, similar to the edge 123 in the third embodiment of the bearing shown in FIG. 16.

Figure 20:
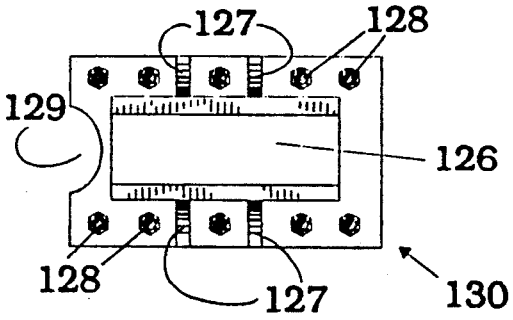
FIG. 20 is a top plan view of FIG. 18.

In FIG. 20, a notched groove 129 is seen to be cut into a front edge of the bearing 130 so that a transverse member sliding in the grooved channel 126 may be able to flex and clear the front edge of the bearing 130. Stability is added to the bearing 130 by the ribs 127 and the bolts 128, especially when a transverse member is sliding in the grooved channel 126.

Figure 21:
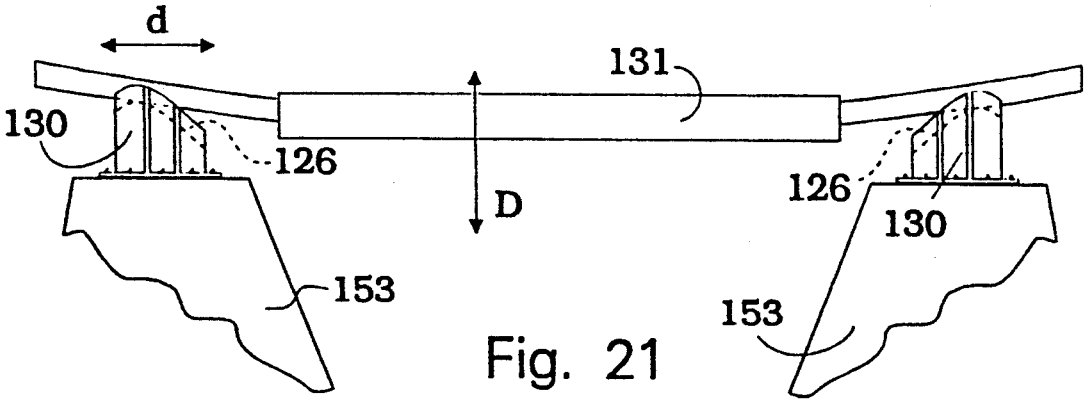
FIG. 21 is a side elevational view of a fifth embodiment of the resilient transverse member resting at its ends on the two opposite bearings shown in FIGS. 18–20.

In FIG. 21, a fifth embodiment of the resilient transverse member of the present invention is illustrated. In this example which is analogous to the structure shown in FIGS. 11–13, a transverse member 131 rests in the grooved channels 126 of the bearings 130 which face each other and which are fastened to two spaced support posts 153. The transverse member 131 has a thickened central portion suspended between the two bearings 130 on the posts 153. The transverse member 131 is capable of bending vertically through a first distance D as it simultaneously slides horizontally through a second distance d which is essentially the length of the inclined channel 126. Thus, as the transverse member 131 bends more through the vertical distance D, the shorter the space becomes between contact points in the grooved channels 126 of the bearings 130.

Heretofore, the bearings 114, 120, 122 and 130 have been shown to be either integral with support posts 113 or secured to support posts 153, respectively, in FIGS. 9–16 and FIGS. 18–21. These posts 113 and 153 are separated and spaced from each other.

Figure 22:
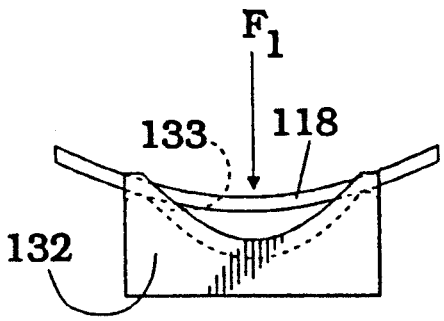
FIG. 22 shows a small force applied to the fourth embodiment of the resilient transverse member, initially shown in FIG. 11, as the member is supported by a fourth embodiment of the bearing of the present invention.
Figure 23:
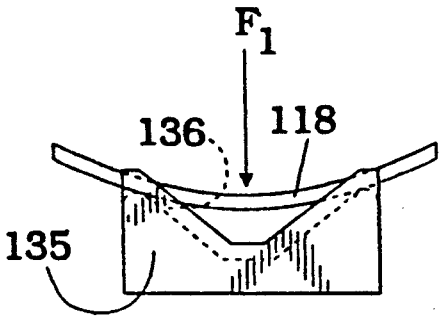
FIG. 23 shows the small force applied to the fourth embodiment of the resilient transverse member supported by a fifth embodiment of the bearing of the present invention.

However, in FIGS. 22 and 23, there are shown one-piece bearing support systems in which the bearings and the support posts are formed integrally with each other.

In FIG. 22, the small force $F_1$, discussed earlier in regard to FIG. 12, is applied to the fourth embodiment of the transverse member 118. In order to reach a state of equilibrium with the small force $F_1$, the transverse member 118 bends and slides a short distance in a single grooved channel 133 of a first one-piece bearing support system 132. Note that the grooved channel 133 has a smoothly curved contour through its central portion. This first system 132 is formed integrally from the support posts and bearings shown in FIGS. 9–16.

Similarly, in FIG. 23, the small force $F_1$ is again applied to the transverse member 118 which likewise, in order to reach a state of equilibrium therewith, bends and slides in a single grooved channel 136 of a second one-piece bearing support system 135. However, the grooved channel 136 is not smoothly curved, but rather is a pair of straight inclined surfaces which lead down to meet at a flat horizontal plane that forms a low central portion of the grooved channel 136.

A key advantage of the straight-lined channel 136 shown in FIG. 23 is that this second system 135 is easier to cast, particularly in concrete for small bridges and the like, than the first system 132 which has the curved channel 133 shown in FIG. 22.

FIGS. 24–28 represent a foundation and parts thereof designed to support a heavy load on multiple transverse members, of which only one is shown for the sake of simplicity. The heavy load may be either a building or another structure elevated above ground by the multiple transverse members which rest on multiple bearings.

Figure 24:
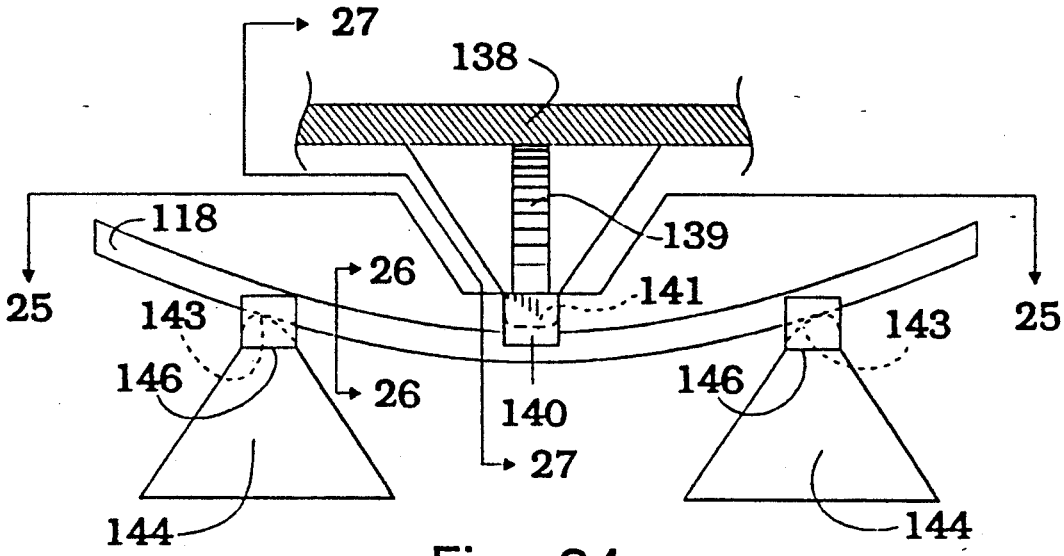
FIG. 24 shows a structure resting upon the fourth embodiment of the resilient transverse member supported by a sixth embodiment of the bearing of the present invention.

In FIG. 24, a platform 138 serves as a basic slab for a heavy load, such as a building (not shown). The platform 138 and its underlying parts, to be described immediately hereinafter, ultimately rest upon a plurality of support posts, such as pyramids 144, of which only two are illustrated for the sake of simplicity. Between the two pyramids 144, there may be a pre-existing structure (not shown), such as a rapid transit rail station, a preserved historic site, and the like.

Immediately underneath the platform 138, there is a plurality of braces 139 extending from an underside of the platform 138. Two or more, usually four of these braces 139 extend downwardly at inclined angles to join at a common meeting point, i.e. an inverted bearing 140 having a grooved channel 141 which wraps partially around a central portion of the resilient transverse member 118. Depending upon the weight of the heavy load (not shown) on the platform 138, the transverse member 118 flexes and slides in grooved channels 143 of cubical bearings 146 mounted on the pyramids 144.

Figure 25:
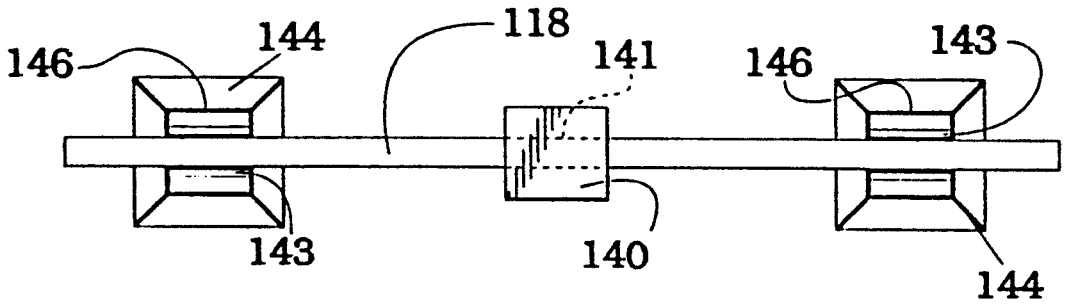
FIG. 25 is a top plan view taken along line 25—25 in FIG. 24.

In FIG. 25, a top plan view, taken along line 25—25 in FIG. 24, is shown of the inverted bearing 140 in which the central portion of the transverse member 118 is partially surrounded by the channel 141. Near to opposite ends of the transverse member 118, there are positioned the pyramids 144 upon which the cubical bearings 146 are secured. The transverse member 118 slides in the grooved channels 143 of the cubical bearings 146.

Figure 26:
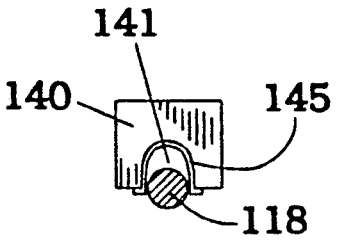
FIG. 26 is a cross-sectional view taken along line 26—26 in FIG. 24.

In FIG. 26, a cross-sectional view, taken along line 26—26 in FIG. 24, is shown of the inverted bearing 140 in which the central portion of the transverse member 118 is partially surrounded by the grooved channel 141, but is lifted somewhat therefrom for the purpose of illustration. As it may be clearly seen, the grooved channel 141 may have the bearing plate 145 of FIG. 17 secured thereon for facilitating the sliding of the transverse member 118 therein. Furthermore, the periodic incremental sliding of the member 118 wears away only the replaceable bearing plate 145 and does not permanently damage or otherwise cut a deeper groove into the channel 141 of the inverted bearing 140. As one may surmise, it would be difficult to replace the entire inverted bearing 140 due to its strategic location in the foundation shown in FIG. 24. It is less difficult to replace only the bearing plate 145.

Figure 27:
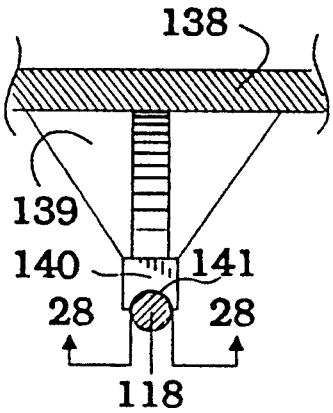
FIG. 27 is a side elevational view taken along line 27—27 in FIG. 24.

In FIG. 27, a side elevational view, taken along line 27—27 in FIG. 24, is shown of the central portion of the foundation, primarily to illustrate the structure of the braces 139 underlying the platform 138. As one may see, there are essentially four braces 139, of which only three are shown in FIG. 27. The braces 139 are identical in that each has an inclined rectangular face and a triangular-shaped side. The four braces 139 are inverted and their apexes are joined at a common point, i.e. the inverted bearing 140 having the grooved channel 141 that partially surrounds the transverse member 118.

Figure 28:
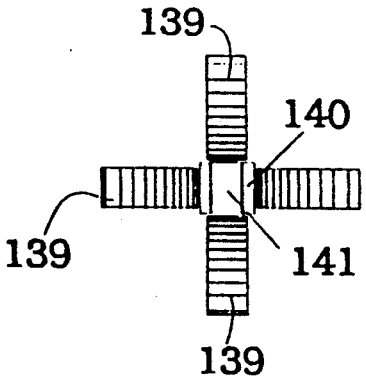
FIG. 28 is a bottom plan view taken along line 28—28 in FIG. 27.

In FIG. 28, a bottom view, taken along line 28—28 in FIG. 27, shows the four braces 139 with their inclined rectangular faces meeting at the inverted bearing 140 which has the grooved channel 141 formed therein.

The foregoing preferred embodiments of the architectural system are considered to be illustrative only. Numerous other modifications and changes will readily occur to those persons skilled in the building industry after reading this disclosure. Consequently, the disclosed invention is not limited to the exact constructions shown and described above, but rather is encompassed within the letter and the spirit of the following claims.

What I claim as my invention is the following:

1. An earthquake-resistant architectural system comprising:

a. at least two support posts;

b. bearings being mounted on the support and facing each other, each of the bearings having a grooved channel which has opposite open ends and is inclined downwardly at an angle from a horizontal ordinate; and c. at least one resilient transverse member having a longitudinal axis aligned coaxially with the horizontal ordinate when the transverse member is unloaded and at rest, said transverse member extending between the bearings and having a point of contact in each grooved channel with end portions of the transverse member overhanging opposite open ends of the grooved channels;

wherein a horizontal distance, when measured in a straight line between the points of contact in each grooved channel, decreases as the resilient transverse member is loaded so that the resilient transverse member bends and slides in the grooved channels.

2. The system according to claim 1 wherein:

said bearings are integral with the support posts and also are inclined at an angle from vertical axes of the support posts.

3. The system according to claim 1 wherein:

said bearings are integral with the support posts and also have vertical axes aligned coaxially with vertical axes of the support posts.

4. The system according to claim 3 wherein:

each of the grooved channels has a rounded upper edge means for allowing the transverse member to remain at rest without causing notches to be cut therein.

5. The system according to claim 1, further comprising:

at least one bearing plate fastened onto one of the grooved channels in the bearings.

6. The system according to claim 1 wherein:

said bearings have a plurality of vertically reinforcing side ribs.

7. The system according to claim 1 wherein:

said bearings each have a notched groove cut into a front edge thereof.

8. The system according to claim 1 wherein:

said support posts and bearings are formed integrally as a one-piece bearing support system.

9. The system according to claim 8 wherein:

said one-piece bearing support system has a single grooved channel with a smoothly curved contour.

10. The system according to claim 8 wherein:

said one-piece bearing support system has a single grooved channel with a pair of straight inclined surfaces which lead down to meet a flat horizontal plane that forms a low central portion of the grooved channel.

11. The system according to claim 1 wherein:

said support posts are pyramidal-shaped and said bearings are cubical-shaped.

12. The system according to claim 11, further comprising:

foundation means for supporting a heavy load on a plurality of the resilient transverse members.

13. The system according to claim 12, wherein:

said foundation means includes a platform, a plurality of braces extending from an underside of the platform, and an inverted bearing at which the plurality of braces join.

14. The system according to claim 13, wherein:

said inverted bearing has a grooved channel which wraps partially around one of the plurality of the resilient transverse members.

15. The system according to claim 14, further comprising:

a bearing plate secured in the grooved channel.

16. The system according to claim 1 wherein:

said transverse member is a cylindrical rod.

17. The system according to claim 1 wherein:

said transverse member is laminated.

18. The system according to claim 1 wherein:

said transverse member is gradually tapered towards its ends.

19. The system according to claim 1 wherein:

said transverse member is recurved upon itself to form opposite c-shaped ends.

20. The system according to claim 19, further comprising:

apertured plate means to which each of the c-shaped ends of the recurved transverse member is attached.

* * * * *

UNITED STATES PATENT AND TRADEMARK OFFICE

CERTIFICATE OF CORRECTION

PATENT NO. : 5,205,528

DATED : April 27, 1993

INVENTOR(S) : John Cunningham

It is certified that error appears in the above-indentified patent and that said Letters Patent is hereby corrected as shown below:

On title page, item [76], "Louthberry" should read --Loughberry--
Column 1, line 10, "earthquakeresistant" should read --earthquake-resistant--
Column 2, line 35, "ar" should read --art--
Column 5, line 46, "e" should read --edge--

Signed and Sealed this

Twenty-second Day of March, 1994

*Attest:*

*Attesting Officer*

BRUCE LEHMAN

*Commissioner of Patents and Trademarks*